US006543919B2

(12) United States Patent
Reiss

(10) Patent No.: US 6,543,919 B2
(45) **Date of Patent: *Apr. 8, 2003**

(54) MOTOR VEHICLE HEADLIGHT WITH MIRROR EQUIPPED WITH AT LEAST ONE LATERAL FENDER SKIRT

(75) Inventor: Benoit Reiss, Paris (FR)

(73) Assignee: Valeo Vision, Bobigny (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/423,379

(22) PCT Filed: Mar. 3, 1999

(86) PCT No.: PCT/EP99/00471

§ 371 (c)(1),
(2), (4) Date: Nov. 4, 1999

(87) PCT Pub. No.: WO99/45311

PCT Pub. Date: Sep. 10, 1999

(65) Prior Publication Data

US 2002/0024817 A1 Feb. 28, 2002

(30) Foreign Application Priority Data

Mar. 4, 1998 (FR) ..... 98 02614

(51) Int. Cl.[7] ..... F21V 7/00

(52) U.S. Cl. ..... 362/516; 362/514; 362/515; 362/343; 362/346

(58) Field of Search ..... 362/516, 514, 362/515, 538, 539, 304, 305, 341, 343, 346, 518

(56) References Cited

U.S. PATENT DOCUMENTS

| | | | | | |
|---|---|---|---|---|---|
| 4,351,018 | A | * | 9/1982 | Fratty | 362/215 |
| 4,566,056 | A | * | 1/1986 | Kouchi et al. | 362/297 |
| 4,772,987 | A | | 9/1988 | Krerschmer et al. | 363/61 |
| 4,800,468 | A | * | 1/1989 | Yokoyama | 362/346 |
| 4,954,938 | A | * | 9/1990 | Lyons | 362/298 |
| 4,964,021 | A | * | 10/1990 | Masin | 362/347 |
| 4,992,911 | A | * | 2/1991 | Ressia | 362/297 |
| 5,060,120 | A | * | 10/1991 | Kobayashi et al. | 362/282 |
| 5,075,828 | A | * | 12/1991 | Gordin et al. | 362/297 |

FOREIGN PATENT DOCUMENTS

| | | |
|---|---|---|
| DE | 35 25 041 | 1/1987 |
| EP | 0 269 975 | 6/1988 |
| FR | 2 639 294 | 5/1990 |
| FR | 2 639 295 | 5/1990 |
| GB | 469750 | 9/1937 |

* cited by examiner

*Primary Examiner*—Sandra O'Shea
*Assistant Examiner*—Guiyoung Lee

(57) ABSTRACT

A motor vehicle headlight comprises a light source co-operating with a mirror and a glass, the mirror having a back and at least one side cheek exposed to radiation from the source. According to the invention, at least one of the cheeks is suitable in at least one zone for reflecting light so as to extend laterally and with continuity the beam generated by the back of the mirror, substantially without reinforcing said beam on the road axis; the glass is smooth or deflects to a very small extent only. Application to homogeneous light beams of great width.

9 Claims, 6 Drawing Sheets

MOTOR VEHICLE HEADLIGHT WITH MIRROR EQUIPPED WITH AT LEAST ONE LATERAL FENDER SKIRT

BACKGROUND OF THE INVENTION

The present invention relates in general to motor vehicle headlights.

Conventionally, a headlight comprises a filament lamp or an arc lamp having its source placed in the region of the focus of a mirror which can be a paraboloid of revolution or any other surface suitable for producing a beam of desired photometric characteristics, possibly in combination with optical arrangements provided on a glass.

For many years there has been a trend, particularly with improvements to bodywork in terms of aerodynamics, towards headlights being made that are small in height, with a reflecting surface that is truncated by a top cheek and a bottom cheek. To prevent these cheeks from reflecting unwanted light to the outside, it is known to associate a mask with the lamp to prevent light from the source reaching said cheeks; it is also known that the cheeks can be coated in a light-absorbing substance such as matt black paint, however that solution can give rise to problems of appearance.

It is also known to design the cheeks so as to prevent them giving rise to radiation that could dazzle the drivers of on-coming vehicles, or so as to enable them to recover the radiation emitted by said source towards said cheeks in a manner that is of use, in particular for the purpose of returning said radiation towards the source.

It sometimes also happens that the mirror of a headlight has side cheeks, particularly if the shape of the mirror is elongate in the vertical direction, even though that kind of headlight has not been much developed since such a vertically elongate shape is not suited to generating a light beam having satisfactory photometric characteristics, and in particular small thickness.

In that case also, in order to ensure that the side cheeks do not reflect unwanted light out from the vehicle, it is necessary to provide means that use solutions based on those known for headlights that are horizontally elongate, and in any event the light flux emitted by the source to the cheeks is lost.

To improve the light efficiency of such a headlight, attempts have already been made to make a headlight whose mirror is defined by side cheeks and in which the cheeks are suitable for reflecting the light from the source so that it can contribute to the light beam.

However, in that case the cheeks have been plane or incapable of properly positioning the images of the source in the beam. It has been more a question of diluting light over the entire field in front of the vehicle, and it has not been shown that that contributes to visual comfort.

Document FR-A-2 639 295 discloses a headlight whose mirror possesses two side cheeks in the form of parabolic cylinders designed to reflect the radiation coming from the source so as to generate portions of the beam that are highly deflected laterally.

Nevertheless, given that the back of the mirror in that case is a paraboloid of revolution focused in the vicinity of the source, it results that the back of the mirror generates a first beam portion that is highly concentrated on the axis of the road, and that the cheeks generate second and third beam portions that are highly offset laterally from the first beam portion, while leaving gaps that are essentially lacking in light between the first beam portion and the second and third beam portions. It is then essential to use a glass that has arrangements for making the beam uniform. However it can be feared that this task imparted to the glass is practically impossible to fulfill, given the large angular offset between the various beam portions upstream therefrom.

Finally, FR-A-2 639 294 discloses a headlight whose mirror possesses cheeks suitable for superposing wider beam portions on relatively narrow beam portions, but in which the wider beam portions contribute to the full lateral extent of the beam.

The cheeks thus contribute to reinforcing light on the axis of the road to the detriment of the quantity of light that is emitted towards the sides, whereas specifically the backs of modern reflectors are suitable for generating a quantity of light on the axis that is sufficient and on the contrary what is required is extra light towards the sides of the road.

BRIEF SUMMARY OF THE INVENTION

An object of the present invention is to mitigate those limitations of the state of the art. The invention thus seeks to take advantage of the lateral cheeks of a headlight mirror so that they add very usefully to the beam generated by the back of the reflector, i.e. so that they improve the photometric qualities of the beam, while still being suitable for use with a glass that is smooth or that deflects very little, and without problems arising of uniformity within the beam. Another object of the invention is to take advantage of mirror side cheeks to reinforce the light towards the sides without excessively increasing the quantity of light on the axis.

Thus, the present invention provides a motor vehicle headlight comprising a light source co-operating with a mirror and a glass, the mirror having a back and at least one side cheek exposed to radiation from the source, the headlight being characterized in that at least one of the cheeks is suitable in at least one zone for reflecting light so as to extend laterally and with continuity the beam generated by the back of the mirror, substantially without reinforcing said beam on the road axis, and in that the glass is smooth or deflects to a very small extent only.

Preferred but non-limiting features of the headlight of the invention are as follows:

- the cheek or at least one of the cheeks has a reflecting surface suitable for positioning all of the images of the light source so that they lie beneath a predetermined cutoff of the beam emitted by the headlight;
- the images of the light source generated by the cheek or at least one of the cheeks have their top points essentially in alignment on said cutoff;
- the source is elongate and extends substantially horizontally and transversely relative to the optical axis of the mirror, and the cheek or at least one of the cheeks has a vertical profile constituted by a top half-parabola and a bottom half-parabola whose focal lengths are different from each other and are such that the respective focal lines thereof pass in the vicinity of the end of the source close to the cheek and in the vicinity of the end of the source remote from the cheek;
- the source is elongate and oriented essentially along the optical axis of the mirror, and the cheek or at least one of the cheeks has a profile such that a light beam emitted tangentially by the edge of the source is reflected in a plane that is essentially horizontal, each light beam emitted by the remainder of the source being reflected with an inclination that is downwards relative to said horizontal plane;

the cheek or at least one of the cheeks has a vertical profile of generally parabolic shape with a focal length that is such that the focal line of the cheek passes in the vicinity of the source;

the axis of said parabola is tilted downwards so as to ensure that the light generated by the cheek or by at least one of the cheeks is directed downwards;

the cheek presents a shape that is cylindrical;

the reflecting surface of the cheek or of at least one of the cheeks is constituted by a plurality of offset steps, said cheek having a vertical section that is generally in the form of a vertical line;

the back of the mirror presents a height that is greater than its width;

the or each cheek of the mirror is made separately from the back and is fitted to said back; and the horizontal section of the or each cheek is inclined outwards relative to an optical axis of the back of the mirror.

BRIEF DESCRIPTION OF THE DRAWINGS

Other features, objects, and advantages of the present invention will appear better on reading the following detailed description of preferred embodiments thereof, given by way of example and made with reference to the accompanying drawings, in which:

FIG. 11 is a front view showing one possible design for the back zone of the mirror of a headlight of

DETAILED DESCRIPTION OF THE INVENTION

Figure 1:
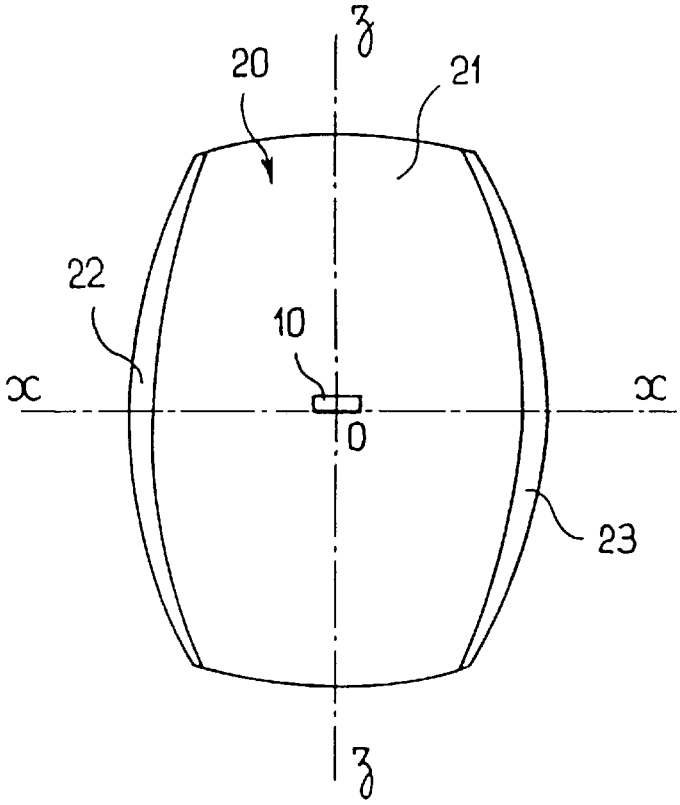
FIG. 1 is a front view of a headlight mirror of the invention, together with the associated source.
Figure 2:
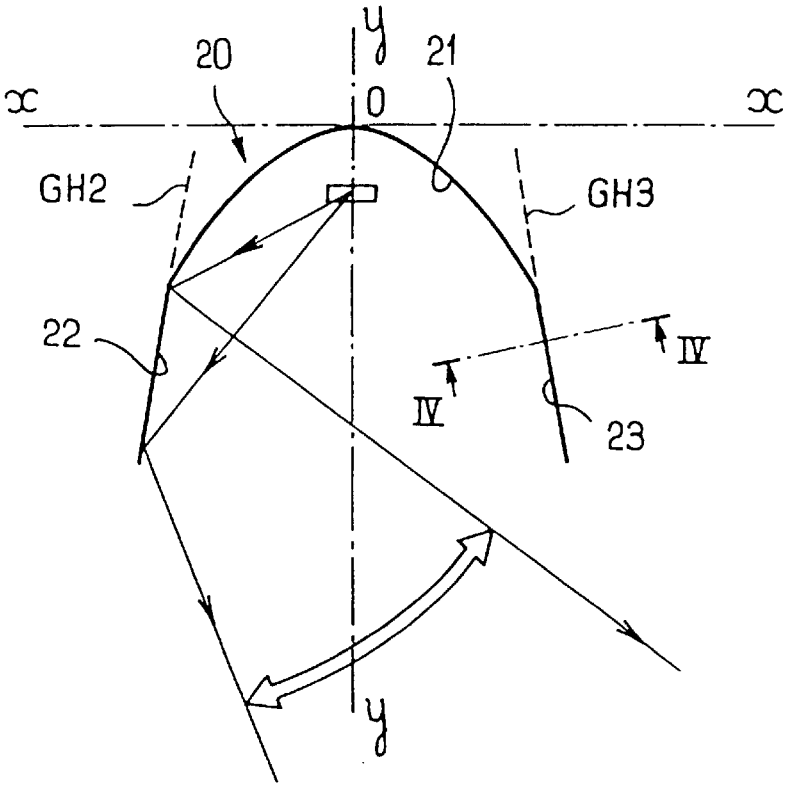
FIG. 2 is an axial horizontal section view of the mirror and the source of FIG. 1.
Figure 3:
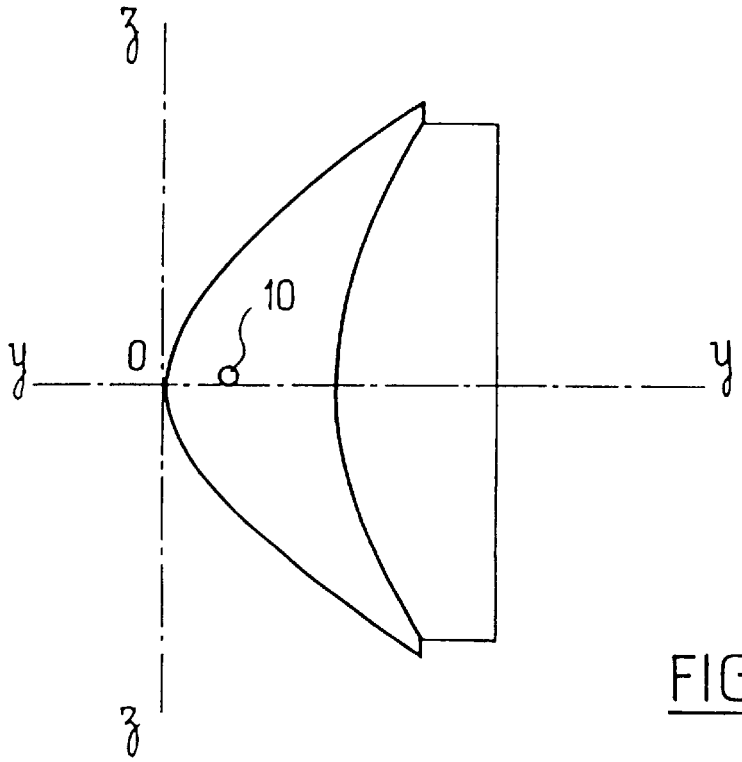
FIG. 3 is an axial vertical section view of the mirror and the source of FIGS. 1 and 2.

With reference initially to FIGS. 1 to 3, there can be seen a portion of a motor vehicle headlight, which headlight comprises a light source 10, a beam-forming mirror 20, and a closure glass (not shown), together, where appropriate, with a case and various fixing and adjustment members that are conventionally fitted to such a headlight.

The source 10 preferably extends horizontally and perpendicularly to the optical axis y—y of the mirror. It can be constituted by the filament of a lamp having a transverse filament such as a standardized "H3" lamp mounted on the back of the mirror, or by the filament of an axial filament lamp in particular of the "H1" or "H7" type mounted in the mirror parallel to the horizontal transverse direction x—x. It can also be the light-emitting arc of a discharge lamp.

The height of the mirror 20 is preferably equal to or greater than its width, and the mirror possesses a back zone 21 and two side cheeks 22 and 23 which truncate the back zone at the sides thereof.

The reflecting surface of the back zone 21, of which various examples are given below, is suitable on its own for generating a light beam optionally defined by a top cutoff. Typically it can be a foglight beam having a horizontal cutoff, or a "European" dipped headlight beam having a horizontal half-cutoff and a half-cutoff that tilts up at about 15°, or a dipped headlight beam in compliance with the regulations of the United States of America which has two horizontal half-cutoffs that are offset vertically, etc., or indeed a main beam.

For example, document FR-A-2 602 305 in the name of the Applicant describes a foglight having a transverse filament, and its teaching can be used for making the back zone 21 in such an application.

The horizontal and vertical dimensions of the mirror, together with the focal length at the base of the back zone 21 can lead to such a mirror being defined by two side cheeks 22 and 23, and in accordance with the invention these cheeks are used so as to contribute to the resulting beam, for example the cheeks can be integrally formed with the back zone 21 and they can be coated with the same reflecting coating as the back zone.

Each of the cheeks is thus given a shape suitable for causing it to reflect light from the source 10 in such a manner as to add to the width of the beam portion that is generated by the back 21, while ensuring that the reflected light is at a height that is appropriate for said beam portion, said height varying as a function of the type of beam generated.

In a first embodiment, suitable for use in a main beam headlight, it is possible for the cheeks 22 and 23 to be given the shape of parabolic cylinders having horizontal generator lines GH2 and GH3 which are essentially parallel to the optical axis y—y, or which flare slightly relative to said axis, as shown in FIG. 2, in particular so as to make the mirror 20 easy to unmold when it is manufactured by injection molding.

The vertical sections of these parabolic cylinders 22 and 23 are then parabolas of focal lengths such that the focal lines of the cylinders pass in the vicinity of the source 10, and preferably through the center thereof.

Under such circumstances, the cheeks 22 and 23 will produce images of the source 10 which will be found, for the most part, astride the horizontal plane that includes the headlight, so as to provide illumination in front of the vehicle both in the distance and angularly offset outwards.

Thus, in the embodiment shown in FIG. 2, it can be seen that the angular coverage CA of the zone 22 lies in the range about 22° to about 43° to the left of the illuminated field, while the angular coverage of the cheek 23 is preferably similar, but to the right of the illuminated field.

If the zone 21 is simultaneously suitable for generating a main beam that has maximum concentration on the axis of the road and spread out to a certain extent in the width direction, e.g. about 25° to 30° to left and to right, then the resulting beam as produced by the zones 21, 22, and 23 will have both the above-mentioned concentration peak and increased width, thereby giving excellent visual comfort, and with this being achieved without significant contribution from the closure glass.

When the headlight is to generate a cutoff beam, the above solution is not necessarily well adapted, at least for the side of the road on which vehicles travel in the opposite direction (i.e. the left when traffic drives on the right), insofar as the cheek concerned produces light above the cutoff.

Under such circumstances, the cheeks 22 and 23 are preferably still made in the form of cylinders, but they are given a vertical profile such that the resulting surfaces are suitable for bringing all of the images of the source below the desired cutoff.

For a foglight having a single horizontal cutoff, the vertical profile is constituted by a top half-parabola having a first focal length and by a bottom half-parabola having a second focal length that is longer than the first.

Figure 4:
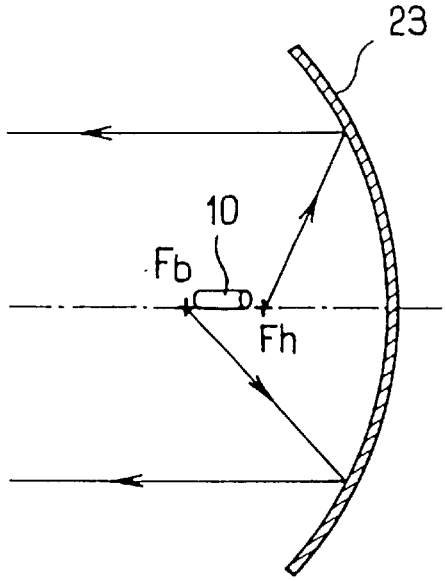
FIG. 4 is a section view on line IV—IV of the FIG. 2 mirror.

FIG. 4 shows this embodiment. The first and second focal lengths are selected in such a manner that the resulting focal lines, whose traces are illustrated respectively by Fh and by Fb in FIG. 4, pass respectively behind and in front of the projection of the source 10 as shown in the same figure, and preferably in the close vicinity of the rear and front ends of said projection (i.e. the ends of the source that are respectively close to the cheek in question and remote therefrom).

In this way, and by analogy with the teaching of document FR-A-2 536 503 relating to a reflecting surface that automatically generates a beam having a horizontal cutoff, all of the images of the source 10 as generated by the cheeks 22 and 23 will be placed beneath a horizontal cutoff, and their top points will be essentially in alignment along said cutoff, covering the above-mentioned angular coverage CA so as to extend the foglight beam as generated by the zone 21 sideways.

In FIG. 1, it will be observed in particular that such cheeks having a closed vertical profile encroach quite significantly on the four corners of the reflecting surface of the back 21, thereby reducing the amount of light flux recovered by said back. If this is to be avoided, then the cheeks 22 and 23 can be implemented in the form of reflecting steps of constant or varying vertical pitch with an example of a suitable vertical profile being shown in FIG. 5. The working surfaces of the steps 231 are based on parabolas of focal length that increase progressively so that they provide the same optical behavior in this case as with the smooth profile of FIG. 4. Cheeks 22 and 23 are thus obtained which extend overall in respective vertical planes, thereby leaving a generally rectangular outline to the back zone 21.

Figure 5:
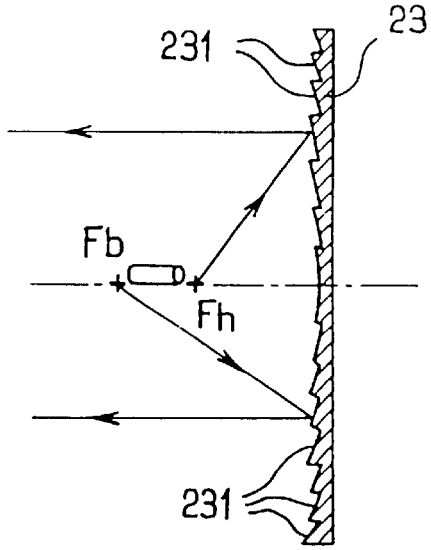
FIG. 5 is a section view on the same line showing a variant embodiment of the mirror.
Figure 7:
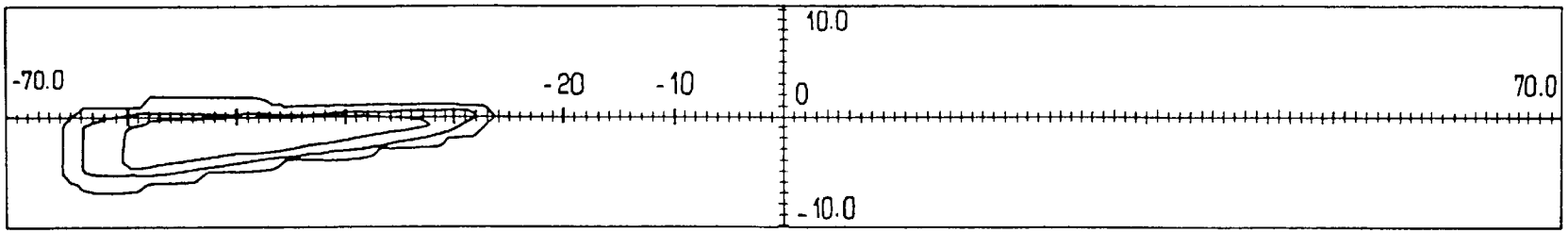

A choice between the smooth surface of FIG. 4 and the stepped surface of FIG. 7 can also be made as a function of criteria to do with style, the FIG. 4 case giving a headlight outline of the type shown in FIG. 1, in particular an outline that has a rounded shape which may be advantageous, while the FIG. 5 case gives an outline that is essentially rectangular and that also can be advantageous. Furthermore, the cheeks 22 and 23 can be given curves that are intermediate by hybridizing the solutions shown in FIGS. 4 and 5.

Naturally, this stepping of the reflecting surfaces of the cheeks 22 and 23 can be implemented in any type of headlight of the invention, and in particular with a main beam headlight having cylindro-parabolic cheeks of the kind described above.

Furthermore, depending in the type of beam desired, and particularly for a dipped headlight beam having an asymmetrical cutoff, it is possible to use right and left cheeks that are of different shapes.

For example, with a European type dipped headlight for driving on the right, where the beam is conventionally defined by a left half-cutoff that is horizontal and by a right half-cutoff that rises at about 15°, the right cheek 22 which illuminates to the left can be made as described above with reference to FIGS. 4 and 5, so as to extend the portion of the beam that is situated beneath the left half-cutoff to the left.

In contrast, the left cheek 23 which illuminates to the right can, without impediment, and indeed advantageously, place its images of the source 10 higher up, providing the images remain situated beneath the sloping half-cutoff. Thus, this cheek can be implemented in the form of a parabolic cylinder as described above for a main beam headlight, or indeed it can be in the form of a surface that is cylindrical or not cylindrical and that aligns images of the source beneath the raised half-cutoff of the beam.

This also provides a beam that is significantly widened, thus providing excellent visual comfort.

In another variant embodiment of the invention (not shown), it is possible to provide for the reflecting surfaces of the cheeks 22 and 23 to be surfaces that are not cylindrical but that have curved horizontal generator lines. This makes it possible in particular to provide fine adjustment of the horizontal angular coverage CA of the light generated by said cheeks, and also to ensure a smooth transition between the light produced by the back 21 and the light produced by the cheeks.

It is also possible, in order to thicken the beam portions formed by the cheeks, to act by unfocusing the focal lines of said cheeks to a greater or lesser extent relative to the center of the source 10 or relative to the front and rear ends of the projection of said source, as appropriate.

In yet another variant, it is possible for a cutoff beam to provide cylindro-parabolic cheeks analogous to those described above for a main beam, but in which the parabolic vertical profiles have their parabola axes tilted downwards to a small extent so as to move the images of the source down so that they lie beneath the cutoff or beneath the half-cutoffs, as appropriate.

A specific embodiment of a headlight of the invention having a cutoff is described below.

The back zone 21 of the mirror has a height of 150 mm and a width of 80 mm, the source 10 being constituted by a transverse filament of length (measured in the x—x direction) equal to about 4 mm, situated halfway up, and halfway across the mirror 20.

Under such circumstances, it is advantageous to use cylindrical cheeks 22 and 23 having top vertical half-profiles in the form of parabolas having a focal length of 38 mm, and bottom vertical half-profiles in the form of parabolas having a focal length of 42 mm.

To facilitated unmolding, the horizontal generator line of each cheek preferably flares at an angle of about 1.5° relative to the axis y—y.

If so desired, this angle can be greater, firstly for the purpose of reducing the lateral deflection of the light reflected by the cheeks, thereby making it possible to adjust the width of the beam, and secondly to prevent the cheeks from masking radiation coming from the back of the mirror, which radiation can be at a substantial lateral inclination relative to the axis y—y.

Figure 6:
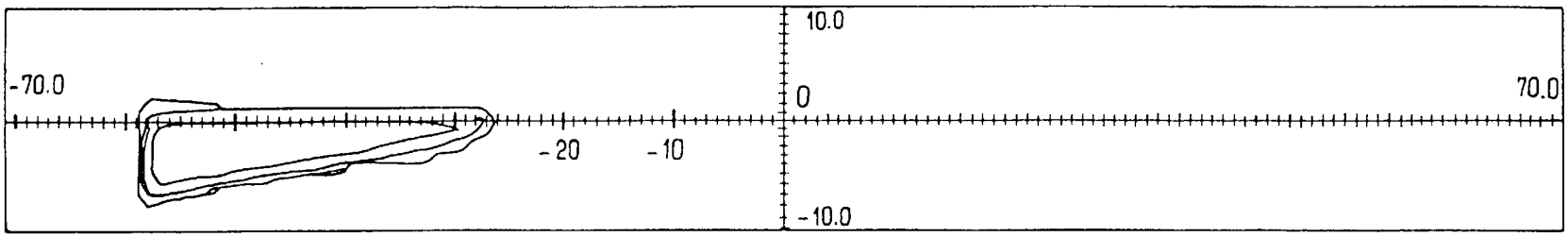
FIGS. 6 and 7 are sets of isocandela curves showing the appearance of the beam portions generated by a cheek zone of the mirror.

FIG. 6 shows the set of isocandela curves representing the appearance of the beam portion generated under such circumstances by the top half of the right cheek 22. It can be seen that the light is offset laterally between about 25° and about 60° to the left, and above all it can be seen that the light is defined by a cutoff that is sharp and horizontal.

In a variant, the cheeks 22 and 23 are made in the form of steps, e.g. 15 steps each 5 mm high in each of the top and bottom half-cheeks, with the steps having focal lengths that vary progressively, e.g. from 38 mm for the steps situated level with the source and 50 mm for the steps furthest away therefrom.

The appearance of the beam portion generated by the top half of the right cheek 22 under circumstances is shown in FIG. 7, and it can be seen that it is very similar to FIG. 6.

Figure 8:
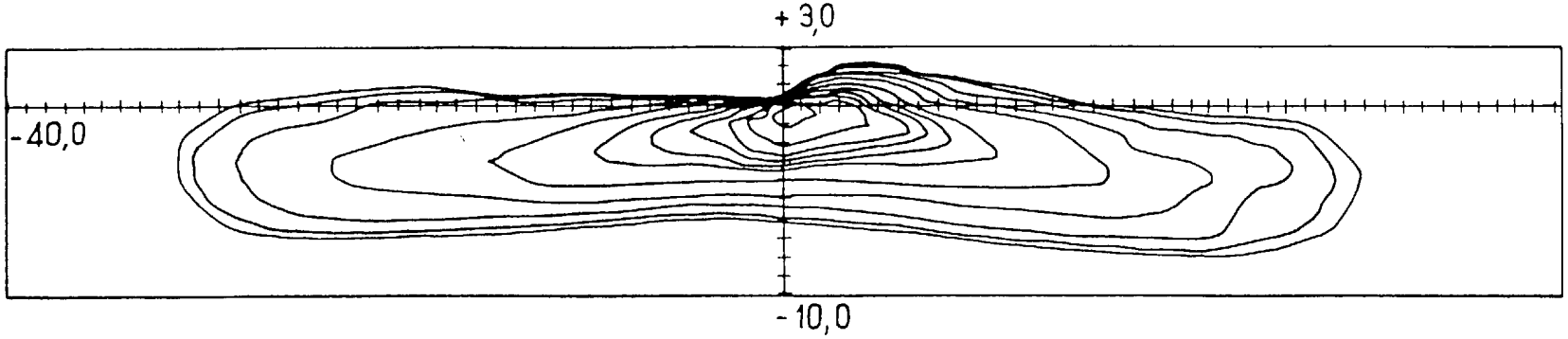
FIGS. 8 and 9 are isocandela curves showing the appearance of two dipped headlight beams of the European type obtained using the present invention.

FIG. 8 shows the appearance of a European type dipped headlight beam for driving on the right as obtained using a back 21, e.g. made as described in greater detail below, and without any contribution from the cheeks. This is a traditional dipped headlight beam of moderate width.

Figure 9:
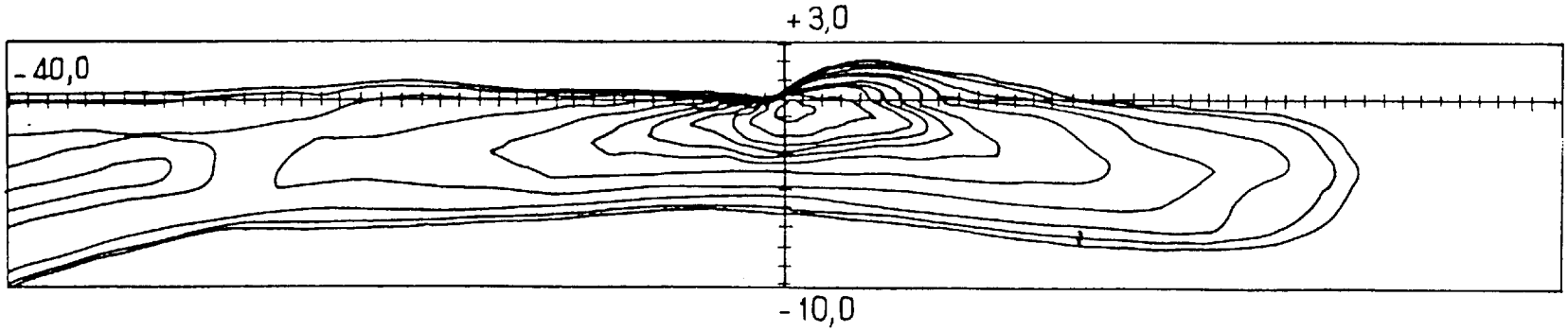

FIG. 9 shows the beam obtained by superposing the beam portions generated by the same back 21 and by the right cheek 22 of the type described above with reference to FIG. 4. Compared with the base beam of FIG. 8, it can be seen that this beam has been extended significantly to the left, this extension being continuous with the beam of FIG. 8. It will be understood that extension of the base beam is said to be "continuous" in the present case when there is no gap in the light in the vicinity of the join, or possibly that there is a decrease in illumination but that it is not sufficient to be troublesome in terms of visual comfort.

A particular embodiment of the back zone 21 is described with reference to FIGS. 10 and 11, this embodiment being suitable on its own to generate a European V-shaped cutoff beam of the kind shown in FIG. 8.

Figure 10:
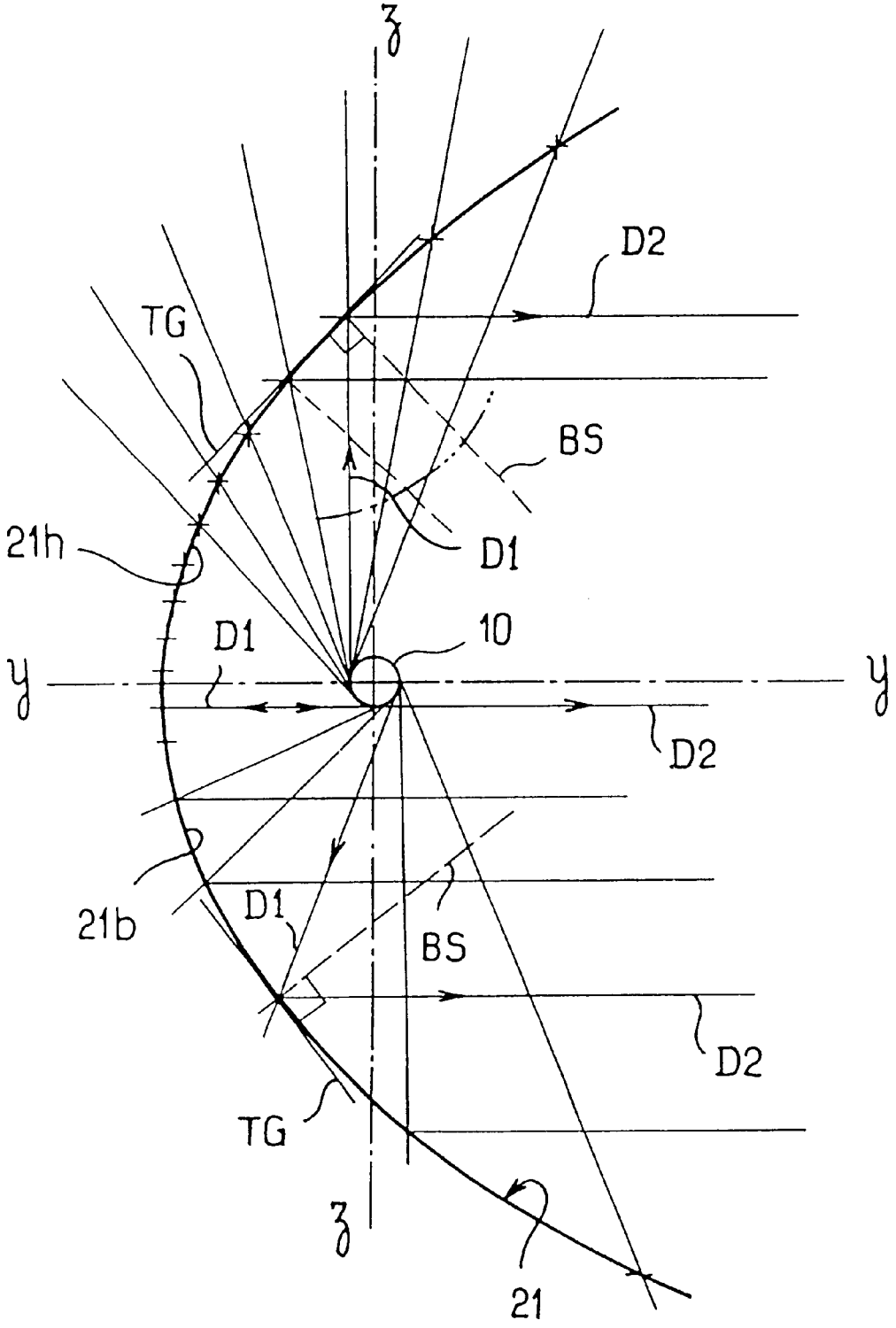
FIG. 10 is an axial vertical section view showing a profile that can be used for making the back or the cheeks of a headlight mirror of the invention.

With reference initially to FIG. 10, the top and bottom vertical generator lines respectively 21*h* and 21*b* of the zone 21 are designed in such a manner as to bring all of the images of the filaments 10 beneath and essentially flush with the horizontal level so as to be able to generate a beam having a high quality sharp cutoff, as explained in greater detail below.

The vertical generator lines are preferably constructed by drawing straight lines D1 tangential to the surface of the filament 10, these straight lines being at the back of the filament for the top generator line 21*h*, and at the front of the filament for the bottom generator line 21*b*.

Each of the straight lines D1 corresponds to a light ray emitted by an edge of the filament 10, and each is associated with a straight line D2 parallel to the optical axis y—y of the mirror, which is itself substantially parallel to the axis of the vehicle.

For each pair of straight lines (D1, D2) the bisector BS and the straight line TG perpendicular to said bisector are determined.

Each generator line is built up by successive approximation starting from the back of the portion 21 of the mirror which is fixed at a determined distance from the filament, on the basis of the various resulting straight lines TG, thereby defining a curved line which is referred to below as an "evolving generator line" given that it does not have a fixed focus but a set of focuses which evolve progressively on moving along said generator line. It will be observed that these generator lines differ in this respect from the fixed focus generator lines, i.e. parabolic lines, that are usually used.

It will be understood at this point that by acting on the horizontal distance between the back of the portion 21 of the mirror 20 and the filament 10, it is possible to design generator lines 21*h* and 21*b* that are open or closed to a greater or lesser extent around the source, and thus to act firstly on the sizes of the filament images that are generated, and secondly on the quantity of light flux that the mirror picks up over a given height.

The differential equations for the generator lines 21*h* and 21*b*, which can easily be solved by computer-assisted design means, can be expressed as follows:

$$\Delta z=\Delta b\cdot(z\cdot\sin\beta-y\cdot\cos\beta)$$

$$\Delta y=\Delta z\cdot\tan(\beta/2)$$

with the following initial conditions:

$$z=-R\text{fil}$$

$$y=-F$$

where:

(y,z) is the rectangular frame of reference whose origin is at the center of the filament 10, y being the horizontal optical axis and z being the vertical;

Rfil is the radius of the filament; and

F is the distance measured along y between the center of the filament and the back of the mirror.

It will be understood that by designing the generator lines 21*h* and 21*b* in this way, each image of the filament 10 as generated thereby is situated immediately beneath and flush with a horizontal cutoff which lies on the axis x—x.

Figure 11:
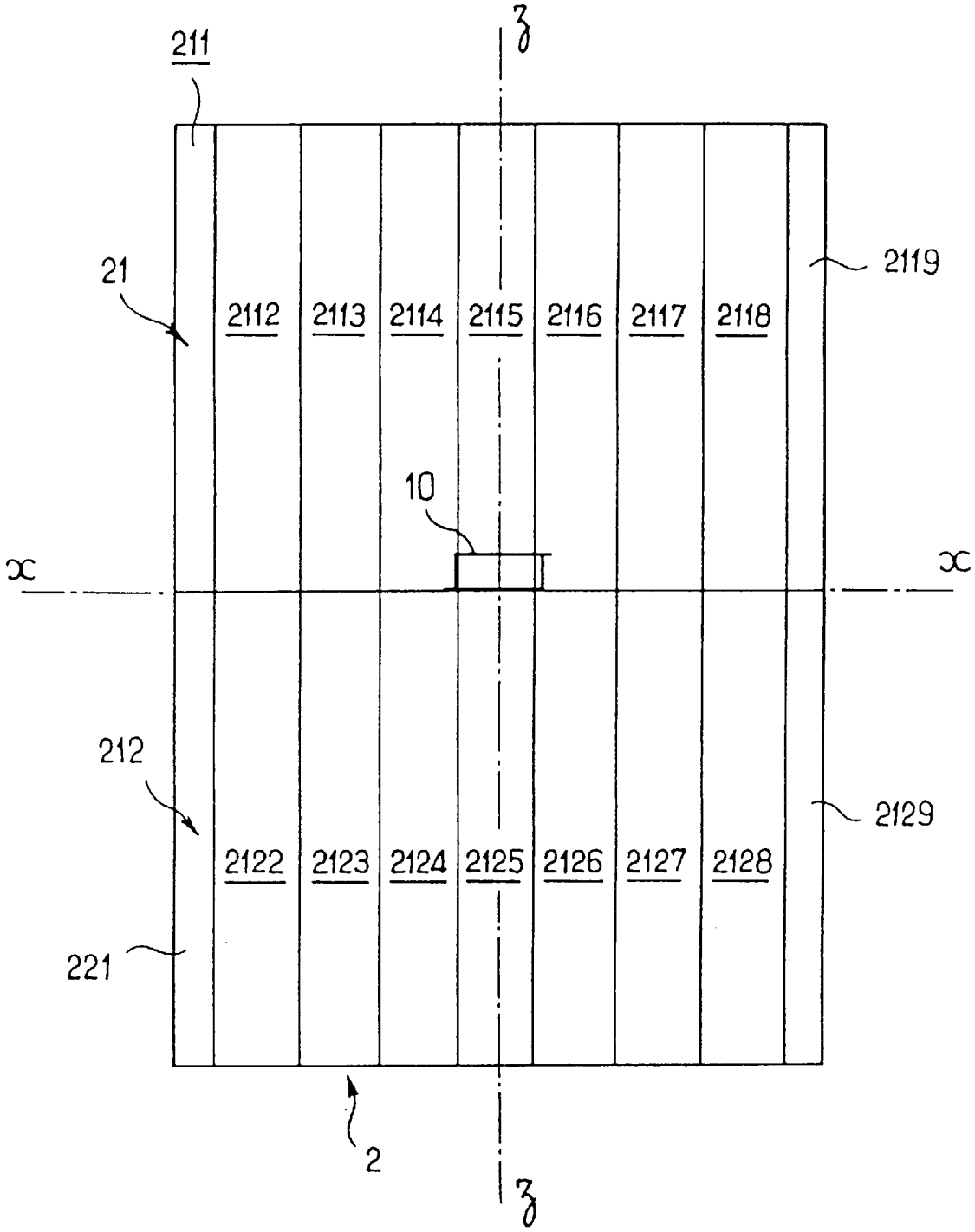

With reference now to FIG. 11, a mirror defined with the vertical generator line as described above with reference to FIG. 10, and suitable on its own, i.e. without any help from a closure glass, for generating a European type dipped headlight beam possessing the required horizontal width, is generated by subdividing the portion 21 of the mirror into a plurality of zones.

In this figure, the back 21 of the mirror possesses a top half 211 and a bottom half 212, each having nine zones, respectively 2111 to 2119 and 2121 to 2129.

In the example shown, the various zones are of substantially similar widths, typically lying in the range 6 mm to 13 mm, and they are essentially characterized by different horizontal generator lines, defined as a function of the lateral offset and of the spread desired for the light.

Thus, the central zones 2115 and 2125 which generate images of the source 10 that are horizontal or inclined very little relative to the horizontal are used to generate the horizontal cutoff over a considerable extent. The horizontal generator lines thereof are advantageously straight lines.

The zones 2114 and 2126 generate filament images which are parallel or slightly inclined relative to the 15° half-cutoff typical of a European dipped headlight beam.

The positions of the filament images generated by these two zones immediately beneath the sloping half-cutoff is preferably determined by using pieces of parabolas for these zones 2114 and 2126, either having horizontal and vertical generator lines with different focuses (the position of the focus of the horizontal generator line determining in particular the symmetrical or asymmetrical positioning of the images relative to the axial vertical plane passing through the reference center of the projection screen), or else and preferably having a horizontal generator line that is parabolic and a vertical generator line that evolves as described above with reference to FIG. 10.

The other zones of the mirror, which are likewise advantageously generated from the vertical generator line of FIG. 10, serve to provide different amounts of spreading of the light, by acting on the horizontal generator lines thereof, while nevertheless complying with the desired cutoff.

The cheeks associated with such a back zone 21 are advantageously made as described above, and enable a beam to be generated that is satisfactory without there being any need for the glass to make the light homogeneous or to correct it. The glass can thus be smooth or only very slightly deflecting.

Naturally, the present invention is not limited in any way to the embodiments described and shown, and the person skilled in the art will be able to make any variant or modification thereto within the spirit of the invention.

In particular, the headlight can have a source that extends axially, in which case it can be advantageous, for a beam having a cutoff, to use a vertical profile for the cheeks 22 and 23 of the kind described above with reference to FIG. 10, since unlike the back 21, these cheeks then "see" the source 10 as a transverse source in a manner that is analogous to the case of FIG. 10.

Although the mirrors described and shown are provided with two side cheeks, the invention naturally also applies to mirrors provided with one cheek only, or with two cheeks of sizes that are different.

It will also be observed that the cheeks 22 and 23 of the mirror can either be made integrally with the back 21, or else can be constituted as add-on parts, thereby eliminating possible difficulties of unmolding a one-piece assembly comprising the back and the cheeks.

Finally, it will be observed that although the above description provides for the entire extent of the cheeks to be used to form the beam that is added to the beam coming from the back, it will naturally be understood that this object can be achieved using only a portion of the extent of said cheeks, with the remainder of the cheeks then being made optically inactive by masking, or otherwise.

What is claimed is:

1. A motor vehicle headlight comprising a light source co-operating with a mirror and a glass, the mirror having a back and at least one side cheek exposed to radiation from the source, at least one of the cheeks being suitable in at least one zone for reflecting light so as to extend laterally and with continuity a beam generated by the back of the mirror, substantially without reinforcing the beam on the road axis, wherein the glass is substantially smooth, the cheek has a reflecting surface suitable for positioning all of the images of the light source so that they lie beneath a predetermined cutoff of the beam emitted by the headlight, the source is elongate and extends substantially horizontally and transversely relative to an optical axis of the mirror, and the cheek has a vertical profile constituted by a top half-parabola and a bottom half-parabola whose focal lengths are different from each other.

2. A motor vehicle headlight comprising a light source co-operating with a mirror and a glass, the mirror having a back and at least one side cheek exposed to radiation from the source, at least one of the cheeks being suitable in at least one zone for reflecting light so as to extend laterally and with continuity a beam generated by the back of the mirror, substantially without reinforcing the beam on the road axis, wherein the glass is substantially smooth, the cheek has a reflecting surface suitable for positioning all of the images of the light source so that they lie beneath a predetermined cutoff of the beam emitted by the headlight, and the source is elongate and oriented essentially along an optical axis of the mirror, and wherein the cheek has a profile such that a light beam emitted tangentially by an edge of the source is reflected in a plane that is essentially horizontal, each light beam emitted by the remainder of the source being reflected with an inclination that is downwards relative to the horizontal plane.

3. A motor vehicle headlight comprising a light source co-operating with a mirror and a glass, the mirror having a back and at least one side cheek exposed to radiation from the source, at least one of the cheeks being suitable in at least one zone for reflecting light so as to extend laterally and with continuity a beam generated by the back of the mirror, substantially without reinforcing the beam on the road axis, wherein the glass is substantially smooth, the cheek has a vertical profile of generally parabolic shape with a focal length that is such that a focal line of the cheek passes in the vicinity of the source, and the axis of said parabola is tilted downwards so as to ensure that light generated by the cheek is directed downwards.

4. A motor vehicle headlight comprising a light source co-operating with a mirror and a glass, the mirror having a back and at least one side cheek exposed to radiation from the source, at least one of the cheeks being suitable in at least one zone for reflecting light so as to extend laterally and with continuity a beam generated by the back of the mirror, substantially without reinforcing the beam on the road axis, wherein the glass is substantially smooth and a reflecting surface of the cheek comprises a plurality of offset steps, the cheek having a vertical section that is generally in the form of a vertical line.

5. A motor vehicle headlight comprising a light source co-operating with a mirror and a glass, the mirror having a back and at least one side cheek exposed to radiation from the source, at least one of the cheeks being suitable in at least one zone for reflecting light so as to extend laterally and with continuity a beam generated by the back of the mirror, substantially without reinforcing the beam on the road axis, wherein the glass is substantially smooth and the back of the mirror presents a height that is greater than its width.

6. A motor vehicle headlight comprising:

a light source for emitting light;

a mirror having a back for reflecting the emitted light to form a beam along a road axis; and at least one cheek configured to reflect the emitted light to extend the beam laterally without substantially reinforcing the beam along a road axis, wherein the cheek has a vertical profile configured to reflect at least a portion of light in a downward direction.

7. A motor vehicle headlight comprising:

a light source for emitting light;

a mirror having a back for reflecting the emitted light to form a beam along a road axis; and at least one cheek configured to reflect the emitted light to extend the beam laterally without substantially reinforcing the beam along a road axis, wherein the cheek has a vertical profile including a top half-parabola with a first focal length and a bottom half-parabola with a second focal length, the second focal length being longer than the first focal length.

8. A motor vehicle headlight comprising:

a light source for emitting light;

a mirror having a back for reflecting the emitted light to form a beam along a road axis; and at least one cheek configured to reflect the emitted light to extend the beam laterally without substantially reinforcing the beam along a road axis, wherein the cheek comprises a plurality of offset steps and has a vertical section generally in the form of a vertical line.

9. A motor vehicle headlight comprising:

a light source for emitting light;

a mirror having a back for reflecting the emitted light to form a beam along a road axis; and at least one cheek configured to reflect the emitted light to extend the beam laterally without substantially reinforcing the beam along a road axis, wherein a height of the back of the mirror is greater than a width of the back of the mirror.

* * * * *

UNITED STATES PATENT AND TRADEMARK OFFICE

CERTIFICATE OF CORRECTION

PATENT NO. : 6,543,919 B2
DATED : April 8, 2003
INVENTOR(S) : Benoit Reiss

It is certified that error appears in the above-identified patent and that said Letters Patent is hereby corrected as shown below:

Title page,
Item [86], please change "PCT/EP99/00471" to -- PCT/FR99/00471 --;
Item [56], References Cited, U.S. PATENT DOCUMENTS, please change the inventor's name "Krerschmer et al." to -- Kretschmer --.

Signed and Sealed this

Twelfth Day of August, 2003

JAMES E. ROGAN
*Director of the United States Patent and Trademark Office*